United States Patent [19]

Feuerlein

[11] 4,063,394

[45] Dec. 20, 1977

[54] SPHERICAL STORAGE TANK FOR GASES AND LIQUIDS, SUPPORTING BASE THEREFOR

[75] Inventor: Peter Feuerlein, Pratteln, Switzerland

[73] Assignee: BUSS AG, Basel, Switzerland

[21] Appl. No.: 734,414

[22] Filed: Oct. 21, 1976

[30] Foreign Application Priority Data

| | | |
|---|---|---|
| Nov. 19, 1975 | Switzerland | 14973/75 |
| Apr. 21, 1976 | Switzerland | 4955/76 |

[51] Int. Cl.[2] ..... E02D 27/34

[52] U.S. Cl. ..... 52/294; 52/167; 220/3; 248/22; 248/146

[58] Field of Search ..... 52/403, 294, 167; 220/3, 5 A; 248/22, 146; 267/141

[56] References Cited

U.S. PATENT DOCUMENTS

| | | | |
|---|---|---|---|
| 1,175,606 | 3/1916 | Clutter | 248/22 |
| 1,572,574 | 2/1926 | Stromborg | 52/167 |
| 2,256,984 | 9/1941 | Lemen | 248/22 |
| 2,792,231 | 5/1957 | Compton | 248/22 |
| 3,120,381 | 2/1964 | Sweeney | 248/22 |
| 3,606,715 | 9/1971 | Wyss | 52/294 |
| 3,643,903 | 2/1972 | Eriksson | 248/146 |

FOREIGN PATENT DOCUMENTS

| | | | |
|---|---|---|---|
| 197,054 | 9/1957 | Austria | 52/80 |
| 71,135 | 10/1959 | France | 52/294 |
| 461,745 | 10/1968 | Switzerland | 52/403 |
| 439,682 | 2/1968 | Switzerland | 52/173 |
| 982,760 | 2/1965 | United Kingdom | 52/403 |

*Primary Examiner*—Price C. Faw, Jr.
*Assistant Examiner*—Henry Raduazo

[57] ABSTRACT

A spherical storage tank holding gases or liquids which is supported on a rigid concrete foundation in a region of the vertical axis of the tank. There is interposed between tank and foundation a mounting rigidly bonded to both the tank and the foundation having generally elastomeric properties. The mounting consists essentially of a plurality of slabs covering the whole upper area of the foundation, in a spaced array leaving only narrow gaps between the individual slabs. The slabs are thin in relation to their size, and the gaps between the individual slabs are filled with a soft-plastic sealant. Moreover, the foundation consists of an upper part and a lower part, between said upper and said lower part being interposed adjustable resilient pads to allow an adjustment of the upper part in relation to the lower part to correct the position of the upper part if the lower part has been displaced due to ground shock waves, underground cavations or the like. The lower part of the foundation has a surface loading as required to press on the ground soliciting it up to near its plasticity.

7 Claims, 6 Drawing Figures

SPHERICAL STORAGE TANK FOR GASES AND LIQUIDS, SUPPORTING BASE THEREFOR

Figure 1:
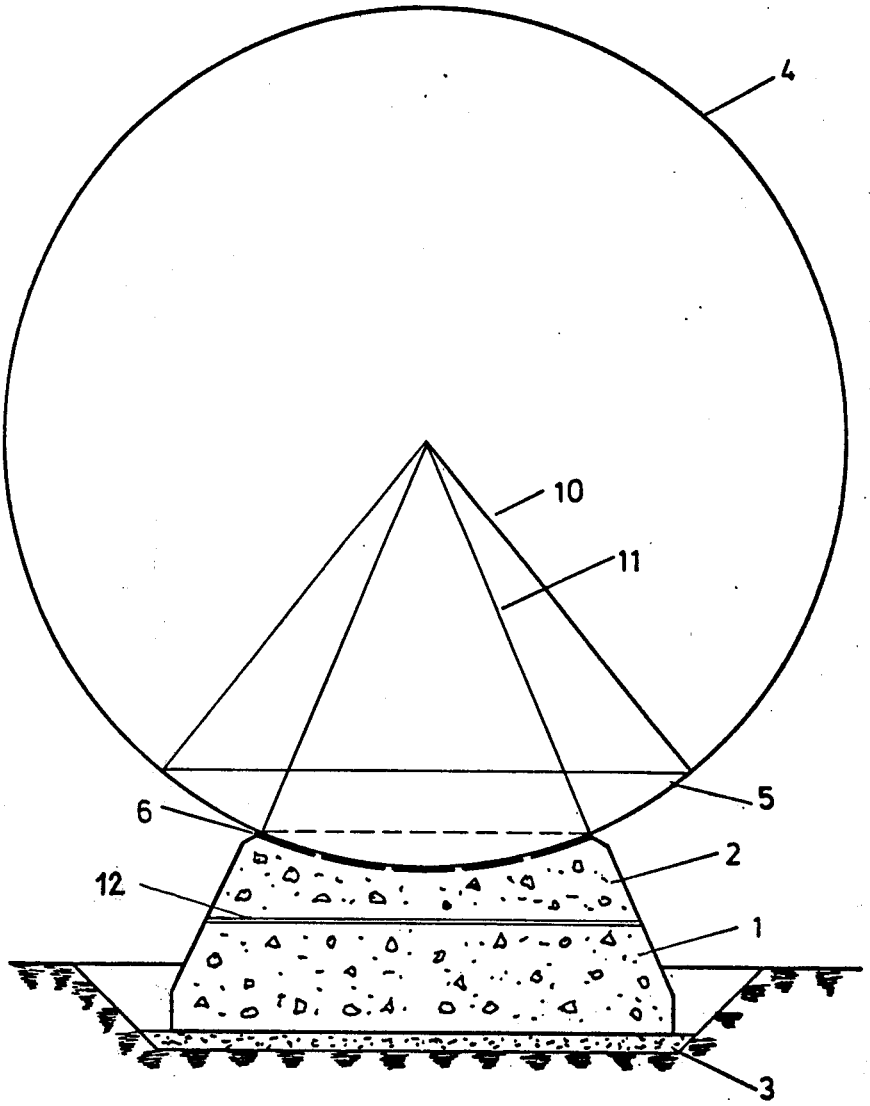

This invention provides a spherical tank for gases and liquids resting on a foundation in the region of the vertical axis of the spherical shell of the tank, there being interposed between the foundation and the spherical shell a mounting, having generally elastic properties and being adhesivly bonded to the spherical shell of the tank and to the foundation.

This invention relates to a spherical storage tank for gases and liquids and a supporting base therefor. Conventionally spherical tanks are supported by lateral struts attached to the external periphery of the shell of the tank. This method of support is open to the objection that changes in the quantity of fluid contained in the tank tend to cause uncontrollable stresses at the connecting points of the struts. Fractures and possibly even the destruction of the tank may ensue. Moreover, in some parts of the world the occurence of earth tremors at irregular intervals presents special problems. In such circumstances costly and technically complex precautionary measures must be taken for dealing with the above-mentioned difficulty or the use of spherical tanks may have to be abandoned altogether.

For overcoming these difficulties it has already been proposed to rest the spherical shell of the tank on a specially prepared gravel bed or on a concrete foundation with or without the interposition of a cushioning layer.

U.S. Pat. No. 3,606,715 for example describes a spherical storage tank and supporting base therefor with a mounting interposed between the tank and the foundation consisting of a material with elastomeric properties and being solidly bonded both to the tank and to the foundation. The construction according to the said Patent provides a mounting wherein there is interposed between the foundation and the spherical shell a plurality of compressible supports having a cellular configuration and consisting of an elastomeric material of good compressive properties, and a flexibly elastic composition pressed into interstitial spaces formed between the compressible supports, said supports and said composition being adhesively bonded by a bonding layer to the shell of the spherical tank and to the foundation.

The combination, as described above, results in an orthotrope transfer of the load and at the same time the bottom of the sphere is effectively isolated from the foundation preventing electrolytic corrosion. This construction has been made use of successfully meanwhile and offers many advantages.

The support area in Swiss Pat. No. 488,906 has almost the form of a spherical surface with a circular horizontal cut-off, wherein the empty tank connects a narrow ring zone of the support area and has in the neighbouring zones a vertical separation from the support surface. According to a preferred embodiment an insulating layer is placed on the support area, the upper surface of the layer being covered with graphite and a corrosion resistant grease. The connection between the tank and the support has no solid bond, therefore a ring is welded to the bottom of the tank and fits into the central hollow of the support with the intent to prevent shifts of the tank on the support.

According to Swiss Pat. No. 439,682 the support covering shell may have a curvature, which is less or which exceeds the curvature of the spherical tank, whereby the tank and the cover of the foundation are both solidly bonded to the interposed layer of material, which may be varied in hardness to obtain a favourable static response.

The support described in Swiss Pat. No. 488,906 has the severe drawback, that on each load change, i.e. when filling or emtptying the tank, occurs a markedly strong and progressing deformation. With a spherical tank as disclosed in Swiss Pat. No. 500,363 such deformation of the tank shell has already been reduced strongly by the membrane forces in the support area, due to the array of compressible cylinders between the tank and the foundation, and where the free area between the individual support cylinders forming an intermediate elastomeric bearing bed are filled with a stiff non-elastomeric but flexible elastic composition. The individual supports divide the total load, so that deformations of the tank shell are smaller and only over the rim of the support cylinders, whereas their surfaces give a shaped support. The flexible elastic composition between the cylinders limits the compensating horizontal forces without a sliding shift.

This latter solution has been successfully applied and also is quite earthquake resistant.

It is the object of the present invention to construct a spherical tank with support, where the safety of bedding is more perfected and the construction simplified still further.

The invention makes use of a mounting for a spherical tank holding gases or liquids which is supported on a concrete foundation in a region of the vertical axis of the tank, the mounting consisting of a layer formed of a material having spring or respectively elastomeric properties and solidly bonded to both the tank and the foundation. According to the invention the layer is formed by slabs covering the whole support area in an array which leaves only narrow gaps between the slabs.

Thus is created a nearly perfectly shaped support for the bottom of the sphere, the support being in effective contact at all times during filling and emptying whereby the influence of stress is materially reduced during load change. Therefore progressing buckling in the shell can no longer occur and destruction would only be possible when overloading up to the limit when plastic flow would start in the shell material.

In a previously known pressure vessel with a divided support having a ring-zone of loose, granular, heaped material, the ideal support shaped to the contour of the shell is effective only once when starting the pressure test with water filling. Afterwards the shell separates from the ring-bed of sand and deforms in this zone. With another known spherical tank solidly bonded to the foundation, the ideal shaped support of the shell is only obtained during full loading conditions.

In regions where earth tremors may occur the supports of spherical tanks will be in addition under forces resulting from the created oscillations. The spherical tank forms together with its changing filling, the foundation and the subsoil a closly coupled system with respect to ground oscillations. The system should have such a low inherent frequency, that it does not show at all or only a dampened response to the seismic frequency of a ground shock. According to the new solution the supporting slabs with elastomeric properties cover almost entirely the support area and the horizontal movements can be kept very small, when the supports are relatively thin plates.

With such supports there exists however a danger if limited disturbances occur locally as a result from ground shifts, cave-ins of natural caverns or underground excavations in mining districts.

It is therefor a further object of the present invention to propose a support for spherical tanks, which overcomes safely the described dangers, especially if ground-shock waves occur.

This further object is attained with a support for a spherical tank to store gases or liquids, having a foundation in the vertical region of the tank and a support layer of material with elastomeric properties solidly bonded to both the tank and the foundation, the foundation itself being divided horizontally into an upper and a lower part with the interposition of adjustable resilient pads and the base having a surface loading as required to press on the ground solliciting it up to near its plasticity.

It may be useful if the upper part of the foundation loaded by the spherical tank has at its bottom a carrying ring with bearing surfaces in groups distributed at the periphery. The spaces between the bearing surfaces are recessed to allow the inserting of leveling means or wedges so that the position of the upper part of the foundation can be adjusted. In this manner the lower part of the foundation may adapt to ground settlement and the upper part can be adjusted accordingly. The construction may be facilitated by the separate assembly of the upper part with the spherical tank at a favourable location and bringing it then to the foundation base erected at the final location.

It is still a further object of the invention to propose a method for the construction of such a spherical tank with support, consisting of the following steps: first and lower part of the sphere is prepared as a calotte, then to the outside of the calotte are bonded the support slabs and the narrow gaps between the slabs are filled with sealing compound. At the same time the lower part of the concrete foundation has been cast and a supporting frame-work has been erected on it. The calotte is set on this framework and the upper part of the foundation is cast, tamped and bonded to the underside of the calotte. The framework being left in the concrete as a further reinforcement. In an alternative to this method, the upper and lower parts of the foundation are being kept separated by a gap into which a second support layer of spring-like material is mounted.

Figure 2:
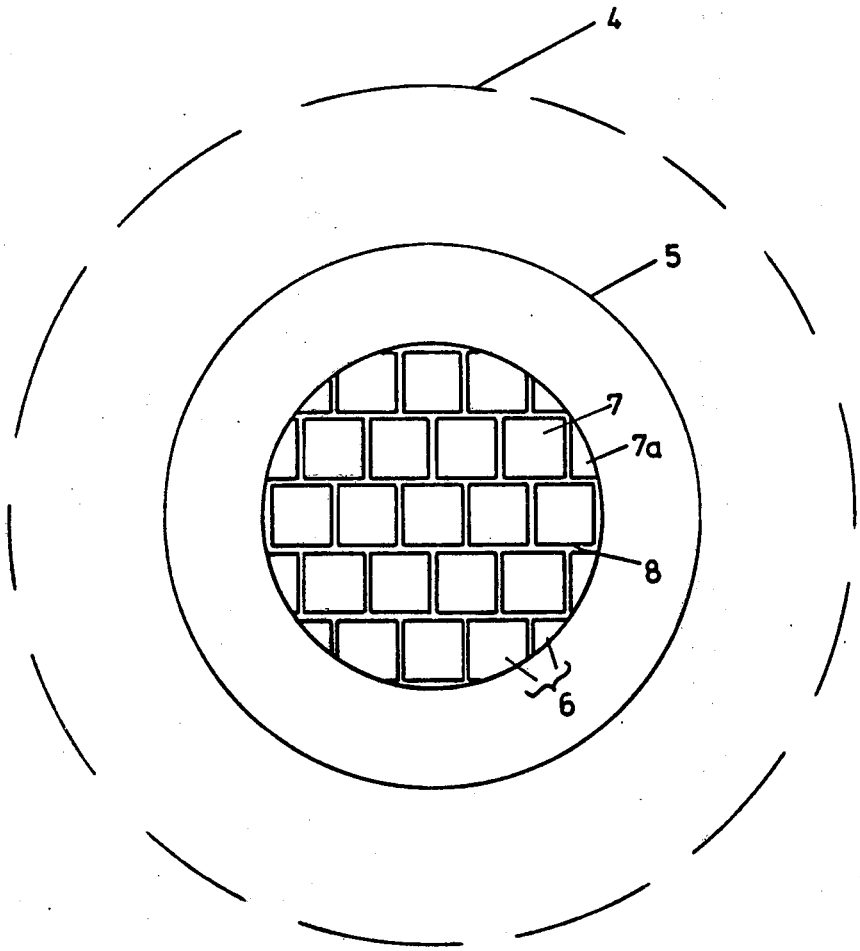
Figure 3:
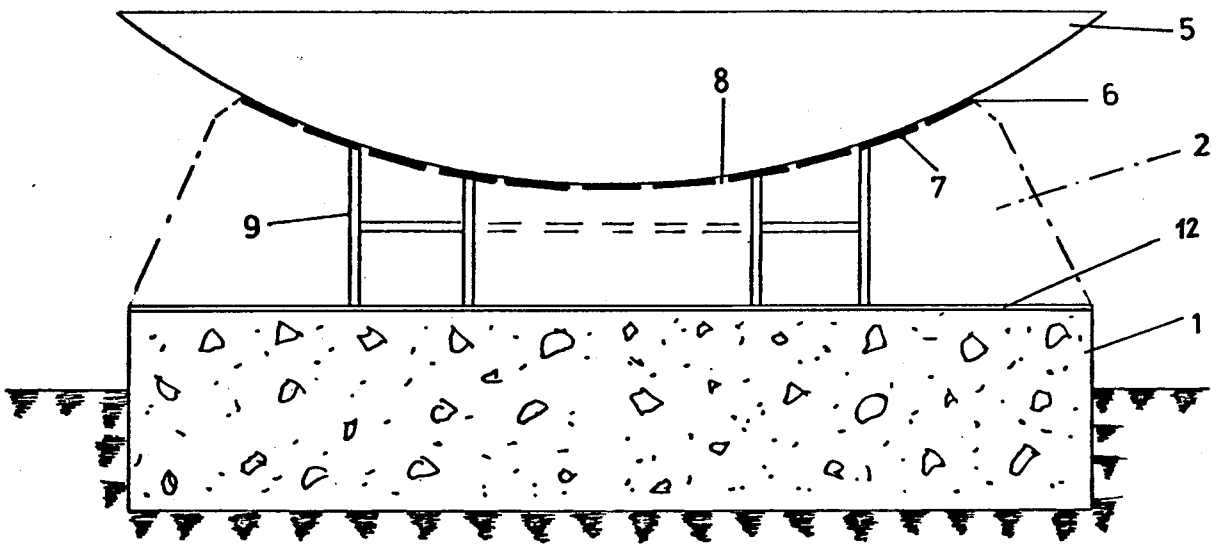
Figure 4:
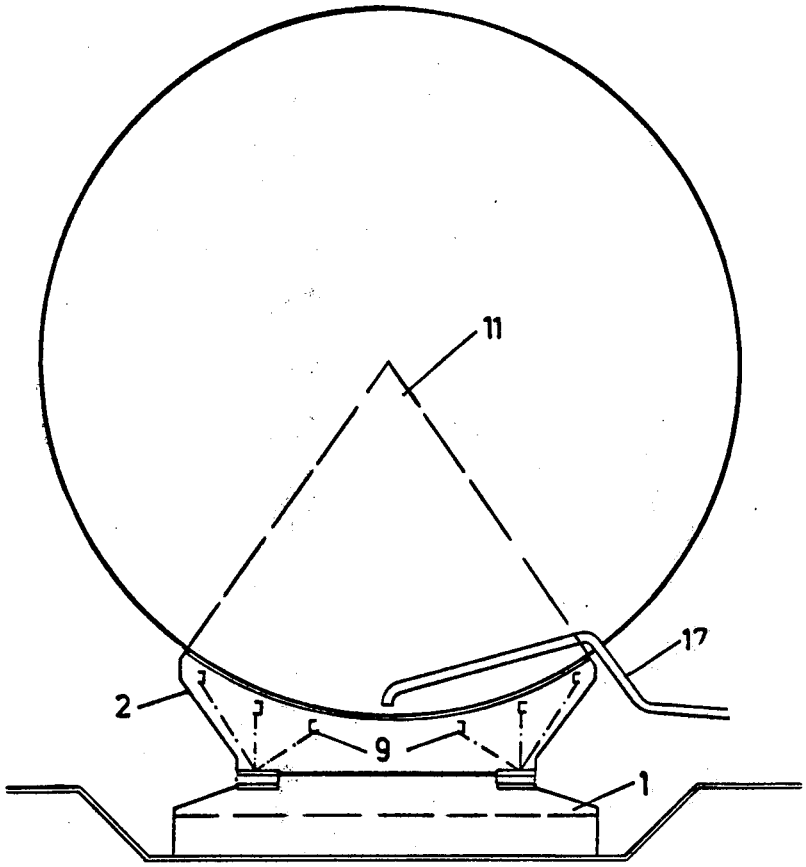
Figure 5:
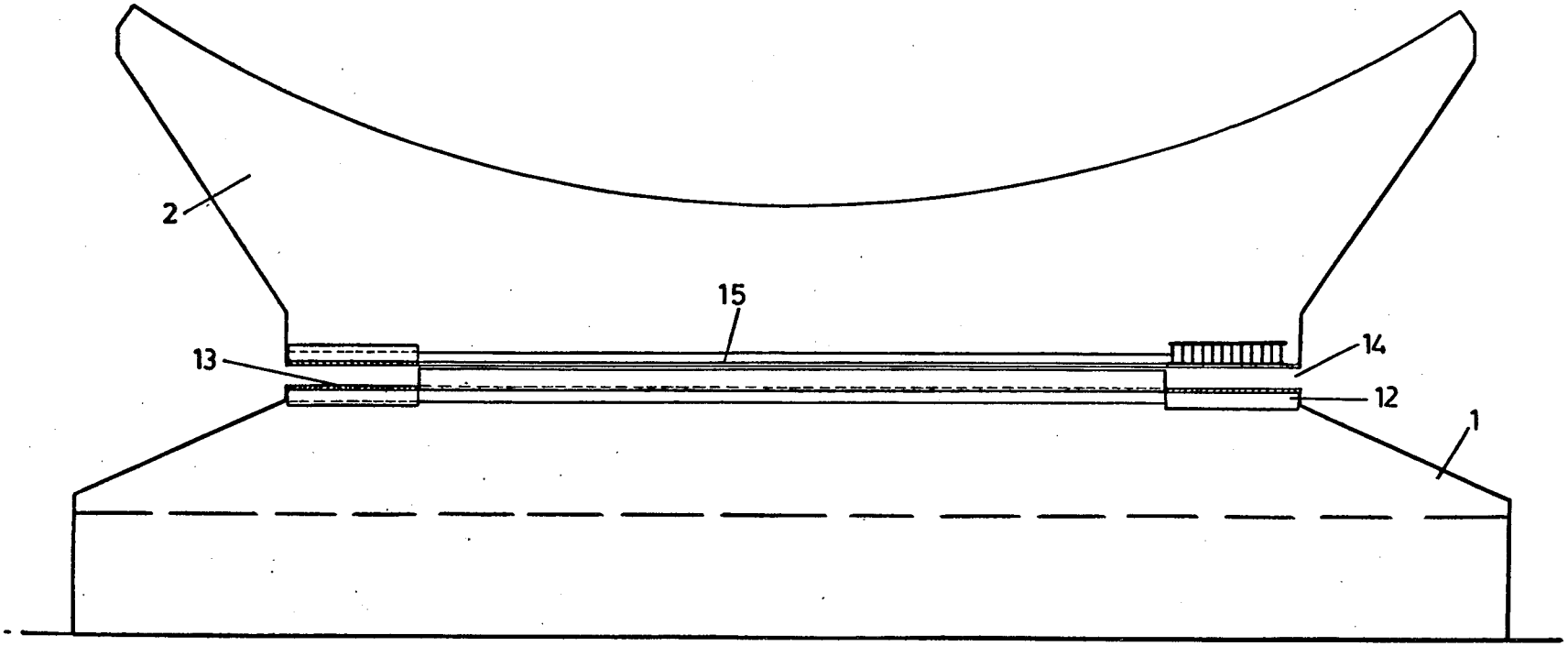
Figure 6:
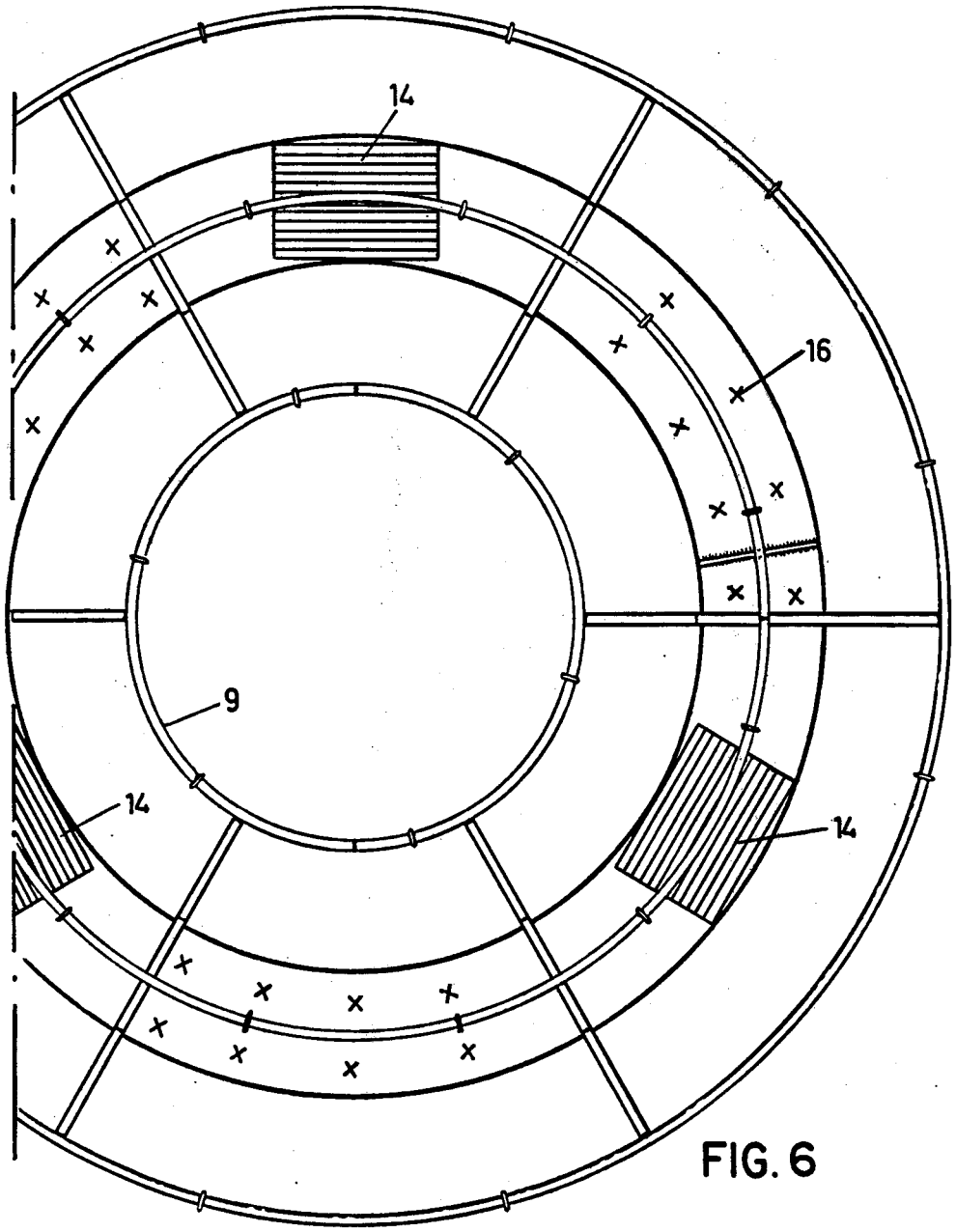

The invention will now be described by way of example and with reference to the accompanying drawings, in which:

FIG. 1 is a vertical section through a spherical tank with its support,

FIG. 2 shows a veiw on the outside of the calotte of the sphere, with the support pads bonded to it, FIG. 3 shows in slightly larger scale a section through the lower part of the foundation with the framework supporting the calotte, FIG. 4 shows an alternative with a two part foundation separated by a gap, FIG. 5 is a further vertical section through a support, at a larger scale, and FIG. 6 is a view on the lower part of the foundation.

FIG. 1 shows the spherical tank 4 serving for example to store a liquefied hydrocarbon with specific density of 0.56 at 38° C. The sphere has a diameter of 28.4 meters and the weight of the maximum filling will be 900 metric tons. The own weight of the sphere with its accessory structures will be approximately 95 metric tons. The tank 4 rests on a concrete foundation with lower part 1 and upper part 2. The design is such that the sphere will be under compression all over the support area, the angle 11 of the center head is selected so that the forces at the boundaries do not exceed the prescribed limits. The sphere is constructed from a low-alloy high-strength steel, with the bottom part calotte under an angle 10 having higher wall thickness of 21 mm, which can be reduced stepwise to 14 mm at the top of the sphere.

In the present example the support area of the calotte 5 has a diameter of 6.2 meters and measures approximately 32 square meters. This support area is being connected to the foundation by the solidly bonded support layer 6. The foundation 1 and 2 is cast in two steps and consists of reinforced concrete and rests on a compacted gravel bed 3.

Details of the support layer are shown in FIG. 2. The layer consists of individual slabs 7 made for example of a rubber with elastomeric properties. Preferred for this is a synthetic rubber based on polychloroprene, which has well balanced high mechanical properties and furthermore is weather-proof and corrosion resistant. Slabs 7*a* at the rim of the surface area have been cut to follow the border.

The slabs are relatively thin compared to their surface area. Use is made for example of slabs 650 × 650 mm with a thickness of 20 mm. The ratio of the square from the dimensions effective in the horizontal and the vertical will give:

$$(20 \times 20/650 \times 650) = (400/422500) = \text{almost } 0$$

The back pressure in the elastomere in the vertical direction will be relatively small and favours transmission of the load forces to the foundation. On the other hand the resistance against horizontal forces will be very large and will tend to deflect them to the less resistant vertical. The distances between the individual slabs are very small so that only narrow gaps result, which are afterward filled by injecting a soft-plastic sealant. The gaps are indicated with 8 in FIG. 2.

With the disclosed solution the horizontal insulation with slabs 7 against oscillations is very high. It can be further increased by using slabs with unfilled holes. For example each slab having six circular holes with 80 mm diameter. An especially advantageous embodiment of the foundation is shown in FIG. 4 to 6 and will be described in detail thereafter.

FIG. 4 shows a spherical tank 4, having for example a capacity of 5,000 cubic meters and filled with liquefied propylene. Filling and discharge is effected through the separate line 17. The tank 4 rests on a concrete foundation divided horizontally and having an upper part 2 and a lower part 1. The mounting between the tank and the foundation may be the same as previously described. The size of the support surface is given by the central angle 11, which is chosen so that the stress in the boundary transition does not exceed a calculated figure. The erection uses an auxilliary support framework 9 which is afterwards left in the cast concrete.

Referring now to FIG. 5 the lower part 1 of the foundation is separated from the upper part 2 in a horizontal plane. The load transfer from the upper part 2, carrying the tank 4, to the lower part 1 is effected by a carrying ring 12 having total 24 bearing surfaces 13 distributed over its periphery. These are grouped in eights together and between the groups are recessed spaces 14 in which leveling means or wedges can be inserted to adjust or correct the position of the upper part 2. The remaining space between the upper 2 and lower 1 parts and not intended to transfer load may be sealed by inserting a foamed material 15.

In the described manner the total load consisting of the proper weight, filling and external forces will be transferred by the bearing surfaces 13 to the lower part 1. If the lower part 1 follows a one sided ground settling, then the upper part may be readjusted with spacers and wedges. The spherical tank will not be under additional stress even with a one sided settling, because the layer interposed between tank and the upper part will assure the maintaining of the support, so that a 2% tilt may still be tolerable. Adjustments are possible up to 6% tilt from the vertical. The adjustments may be executed later if the tank is kept filled to a low level only.

The described bearing surfaces 13 may be provided preferably with resilient rubber pads 16 (see FIG. 6). Such rubber pads can be selected for a long time loading of 160 tons each and with a form suitable also for other tanks with different spherical dimensions. The rubber chosen is a copolymer based on butadiene and has a free surface with interior hollows. These change in size during compression and can be dimensioned to suit.

When constructing the spherical tank, one first makes the bottom of the sphere as a reversed calotte 5 as shown in FIG. 2. Then the area for the support layer 6 is coated with adhesive and the slabs 7 are bonded to it. At the same time the lower part 1 of the foundation has been cast on the compacted bed of gravel 3 and the support framework 9 (shown in FIG. 3) has been mounted on it. Then the gaps 8 between the slabs 7 are filled with injecting the high viscosity sealant of plastic material. The sealant does not harden completely but settles to a soft plastic state. Preferred as a sealant are thiokols. Afterward the slabs 7 are coated with a bonding adhesive, the calotte 5 is turned over by 180° and set on the framework 9. Thereafter the second concrete is cast and vibrated in for the upper part 2 of the foundation, the framework 9 remaining in the concrete as additional reinforcement. A saving results because the metal shell used up to now to cover the foundation is not being required.

An almost perfect shaped support is achieved by the method disclosed above, effective at all stages of filling or emptying. Furthermore, the manner of stressing under load has been reduced to the most advantageous.

The calotte bottom of the sphere is then completed to form the tank by welding on the appropriate plates and accessories.

When constructing the support for a spherical tank, the following disadvantageous conditions may have to be met:

a. The base of the foundation is not exactly horizontal but tilted due to ground settlement.

b. A ground shift might occur in any position or direction whereby a broad center strip of the base having a width of about 3.5 meters lies hollow and does not bear or alternatively only a center strip of 2 meters width bears and the remainder is hollow.

c. A sudden ground shift produces a shock wave with a frequency of 20 – 30 cycles per second and having half a minute duration.

Furthermore it is assumed that the space curvature on which the base rests is a saddle or shallow depression with a minimum radius of 2000 meters.

In such cases the support method above disclosed can be used with success. A one single surface as rigid as possible is made use to account for unequal settling or ground shift. With this support it is aimed to pressure load the ground under the foundation as high as permissible and near its point of change to plasticity. Plasticity of the ground will tend to prevent or dampen strongly the effects which might result from settling or a sudden shift.

The forces which might occur as a result of the conditions (a), (b) and (c), as assumed above, are taken up by the lower part 1 of the foundation, the height of which is selected in such a manner that the stresses can be transferred by the concrete itself.

The upper part 2 of the foundation may be considered to act in practice as a disc to which the forces are equally transferred by the 24 bearing surfaces 13, distributed on a circle with 9.2 meters diameter. When dimensioning the upper part 2 one has to consider of course all the resulting radial, tangential and rim bending moments.

Structural ground shifts are different from tectonic earthquakes in that they appear as shocks generally with a frequency above 40 cycles per second. Therefore one must assure that the own natural frequency of the construction is only one third to a quarter of the exciting frequency. In the present example the support bearings 13 have been adjusted to an own frequency of 5 cycles per second with maximum filling and 8 cycles per second with minimum filling of the spherical tank, providing a high degree of isolation against oscilliation.

I claim as my invention:

1. In combination, a spherical tank for gases and liquids, a rigid load-bearing concrete foundation for said tank below the region of the vertical axis of said spherical tank; said mounting having elastomeric properties and being securely bonded to the underside of said spherical tank and to said foundation; said mounting consisting essentially of a plurality of slabs made of polychloroprene rubber covering the whole upper area of the foundation in a spaced array leaving only narrow gaps between the individual slabs; the slabs being thin in relation to their size; and said gaps between slabs filled with a high viscosity soft plastic-sealant made of polysulfide elastomer material.

2. The combination as claimed in claim 1, wherein said slabs are equipped with a plurality of circular openings.

3. A spherical tank for gases and liquids; a rigid load-bearing concrete foundation in the region of the vertical axis of said spherical tank; and a mounting adhesively interposed between said foundation and at the underside of said spherical tank; said mounting having elastomeric properties and being solidly bonded to the underside of said spherical tank and to said foundation; said mounting consisting essentially of a plurality of slabs covering the whole upper area of the foundation in a spaced array leaving only narrow gaps between the individual slabs; the slabs being thin in relation to their size; and said gaps between said slabs being filled with a soft-plastic sealant; said foundation being divided in an upper part and a lower part; a plurality of adjustable resilient pads being interposed between said upper part and said lower part to allow adjustment of said upper part in relation to said lower part; and said lower part having a surface loading as required to press on the ground and bring the ground material up to its plasticity.

4. A combination as claimed in claim 3, wherein said resilient pads are arranged on a supporting ring, said pads being arranged in groups of eight along the periphery of the supporting ring.

5. A combination as claimed in claim 4, wherein recessed spaces are arranged between said groups of pads into which leveling means or wedges can be inserted to adjust or correct the position of the upper part of the foundation.

6. A combination as claimed in claim 4, wherein said pads are made of rubber.

7. A support for a spherical tank as claimed in claim 5, wherein said lower part of said foundation together with said supporting pads have a resonant frequency which is only a fraction of the frequency caused by structural changes in the ground supporting said foundation.

* * * * *